US009060402B2

(12) United States Patent
Wang et al.

(10) Patent No.: US 9,060,402 B2
(45) Date of Patent: Jun. 16, 2015

(54) STATE CYCLING APPARATUS AND METHOD, AND CONTROL CIRCUIT FOR A LAMP

(75) Inventors: Chin-Hui Wang, Taipei County (TW); Peng-Ju Lan, Taipei County (TW); Chen-Jie Ruan, Shanghai (CN)

(73) Assignee: RICHPOWER MICROELECTRONICS CORPORATION, Grand Cayman (KY)

( * ) Notice: Subject to any disclaimer, the term of this patent is extended or adjusted under 35 U.S.C. 154(b) by 0 days.

(21) Appl. No.: 13/610,218

(22) Filed: Sep. 11, 2012

(65) Prior Publication Data

US 2013/0026944 A1 Jan. 31, 2013

Related U.S. Application Data

(62) Division of application No. 12/750,974, filed on Mar. 31, 2010, now abandoned.

(30) Foreign Application Priority Data

Apr. 2, 2009 (TW) ..... 98110987 A

(51) Int. Cl.
*H05B 33/08* (2006.01)
*H05B 37/02* (2006.01)

(52) U.S. Cl.
CPC ..... *H05B 33/0842* (2013.01); *H05B 37/029* (2013.01)

(58) Field of Classification Search
CPC ..... H05B 33/0815; H05B 33/0842; H05B 33/0845; H05B 37/029; H05B 37/02; F21L 4/027; F21V 23/0414; Y02B 20/346; F21Y 2101/02; H02J 7/00
USPC ..... 362/555, 552, 249.16, 249.19, 811, 362/810; 315/208, 193, 187–188, 153, 315/200 A, 241 S, 307, 297, 316
See application file for complete search history.

(56) References Cited

U.S. PATENT DOCUMENTS

| | | | | |
|---|---|---|---|---|
| 5,115,169 | A * | 5/1992 | Aoki | 315/241 R |
| 7,015,654 | B1 * | 3/2006 | Kuhlmann et al. | 315/291 |
| 7,851,737 | B2 * | 12/2010 | Crouse et al. | 250/205 |
| 2010/0176750 | A1 * | 7/2010 | West | 315/362 |

* cited by examiner

*Primary Examiner* — Tuyet Vo
*Assistant Examiner* — Henry Luong
(74) *Attorney, Agent, or Firm* — Muncy, Geissler, Olds & Lowe, P.C.

(57) ABSTRACT

A state cycling apparatus uses a capacitor instead of complicated and expensive microcontroller to fulfill a state cycling function of a system. The state cycling apparatus includes an internal circuit in the system connected to the capacitor. In a first embodiment, the internal circuit reads the voltage level on the capacitor at power on to determine a current state for the system, and writes the voltage level corresponding to a next state of the system to the capacitor. In a second embodiment, the system reads the state data stored in the internal circuit to determine a current state for the system at power on, the capacitor is charged during the system is under power on, and the capacitor provides power for the internal circuit to store a state data after the system is powered off.

3 Claims, 4 Drawing Sheets

STATE CYCLING APPARATUS AND METHOD, AND CONTROL CIRCUIT FOR A LAMP

RELATED APPLICATIONS

This application is a Divisional patent application of co-pending application Ser. No. 12/750,974, filed on 31 Mar. 2010 now abandoned, now pending. The entire disclosure of the prior application Ser. No. 12/750,974, from which an oath or declaration is supplied, is considered a part of the disclosure of the accompanying Divisional application and is hereby incorporated by reference.

FIELD OF THE INVENTION

The present invention is related generally to a state cycling apparatus for switching system states and, more particularly, to a state cycling apparatus for a lamp.

BACKGROUND OF THE INVENTION

For light emitting diode (LED) applications, such as LED flashlights, to meet various demands, it usually provides several states, such as a strong state, a weak state, and a flashing state, for users to choose therebetween; hence, a state cycling apparatus is required for switching between the states. Conventionally, a state cycling apparatus uses a microcontroller and a non-volatile memory which, coupled with switching operation for the power switch of a LED flashlight, enable the switching between the states. When the LED flashlight is powered on, the microcontroller reads a state data stored in the non-volatile memory so as to switch a state of the LED flashlight. When the LED flashlight is powered off, another state data corresponding to the next state is stored in the non-volatile memory. However, state cycling of LED flashlights is simple and usually involves less than 10 states, and thus it is not cost-effective for LED flashlights to work in conjunction with an intricate, expensive microcontroller.

Therefore, it is desired a low cost state cycling apparatus.

SUMMARY OF THE INVENTION

An object of the present invention is to provide a state cycling apparatus using a capacitor to implement a state cycling.

Another object of the present invention is to provide a state cycling method using a capacitor to implement a state cycling.

Yet another object of the present invention is to provide a control circuit for a lamp.

According to the present invention, a state cycling apparatus for switching a state of a system includes a capacitor and an internal circuit connected to the capacitor. When the system is powered on, the internal circuit reads a voltage level of the capacitor so as to determine a current state of the system and writes another voltage level corresponding to a next state to the capacitor.

According to the present invention, a state cycling method for switching a state of a system includes reading a voltage level of a capacitor connected to the system when the system is powered on, so as to determine a current state of the system, and then writing another voltage level corresponding to a next state to the capacitor.

According to the present invention, a state cycling apparatus for switching a state of a system includes a capacitor and an internal circuit connected to the capacitor. When the system is powered on, the capacitor is charged, and the system reads a state data stored in the internal circuit so as to determine a current state. When the system is powered off, the capacitor supplies power to the internal circuit so as to retain the state data stored in the internal circuit.

According to the present invention, a state cycling method for switching a state of a system includes reading a state data stored in the system so as to determine a current state when the system is powered on, charging a capacitor connected to the system during the system is on, and after the system is powered off, supplying power by the capacitor for storing the state data.

According to the present invention, a control circuit for a lamp includes a capacitor and a controller connected to the capacitor. The controller may switch the lamp between several states. When the lamp is powered on, the controller reads a voltage level of the capacitor, switches the lamp to one of the states according to the voltage level, and writes another voltage level corresponding to a next state to the capacitor.

According to the present invention, a control circuit for a lamp includes a capacitor and a controller connected to the capacitor. The controller may switch the lamp between several states. The capacitor is charged during the lamp is on. When the lamp is powered on, the controller reads a state data stored therein so as to determine a current state. After the lamp is powered off, the capacitor supplies power to the controller so as to retain the state data stored therein.

By using a capacitor instead of an intricate, expensive microcontroller to implement state cycling, it is thus more cost-effective than prior arts.

BRIEF DESCRIPTION OF THE DRAWINGS

These and other objects, features and advantages of the present invention will become apparent to those skilled in the art upon consideration of the following description of the preferred embodiments according to the present invention taken in conjunction with the accompanying drawings, in which.

DETAIL DESCRIPTION OF THE INVENTION

Figure 1:
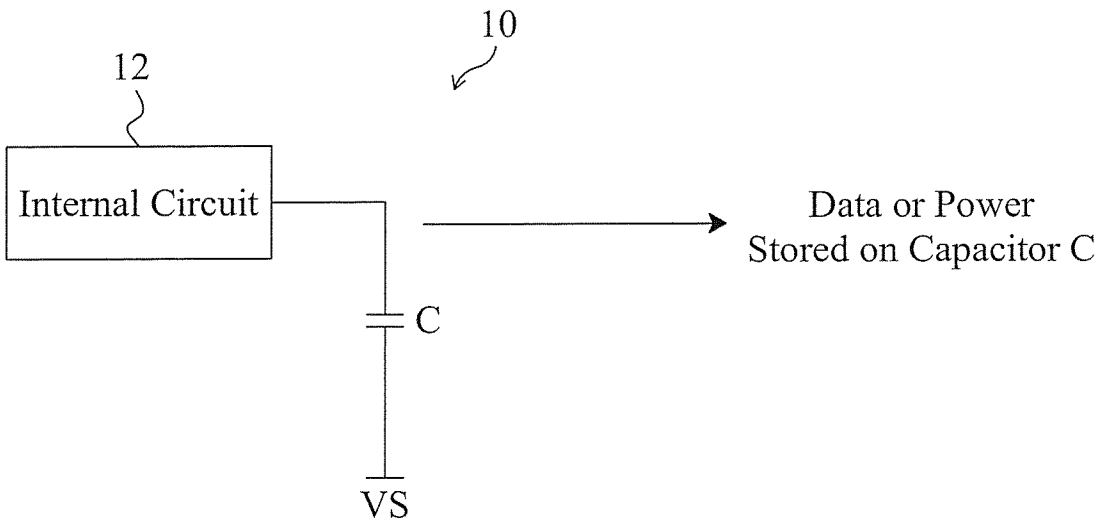
FIG. 1 shows a state cycling apparatus according to the present invention.

According to the present invention, as shown in FIG. 1, a state cycling apparatus 10 for switching a state of a system includes a capacitor C and an internal circuit 12 of the system that is connected to the capacitor C. The internal circuit 12 uses the capacitor C to store power or state data while the system is powered off. Hence, once the system is powered on, a current state of the system can be determined by reference to power or state data stored on the capacitor C. In some states that need an oscillating frequency, such as a flashing state, the internal circuit 12 charges and discharges the capacitor C so as to generate the oscillating frequency.

Figure 2:
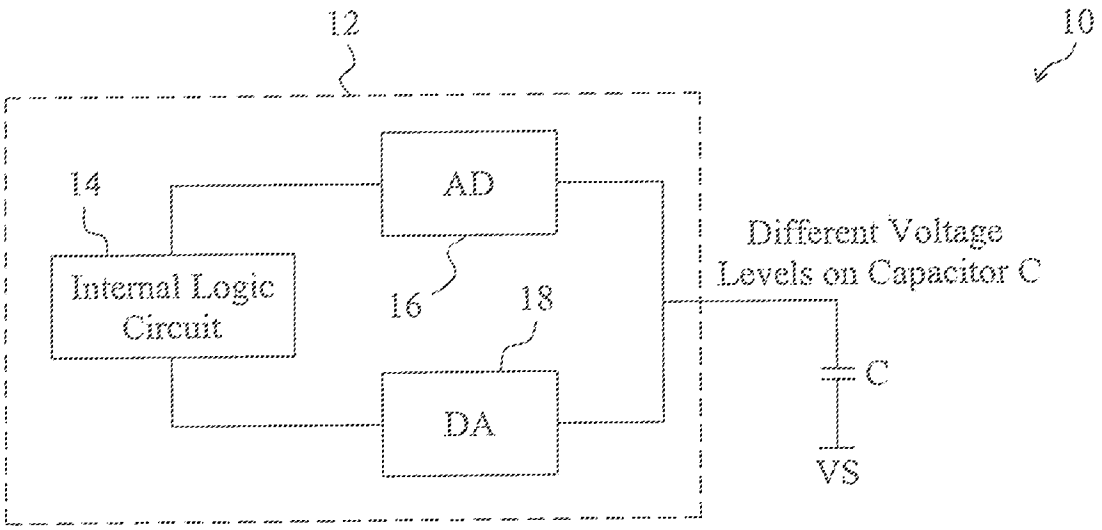
FIG. 2 shows a first embodiment for the internal circuit of FIG. 1.

FIG. 2 shows a first embodiment for the internal circuit 12 of FIG. 1, which includes an internal logic circuit 14, an analog-to-digital converter 16 connected between the internal logic circuit 14 and the capacitor C, and a digital-to-analog converter 18 connected between the internal logic circuit 14 and the capacitor C. When the system is powered on, the analog-to-digital converter 16 reads the analog voltage level on the capacitor C and converts it into a digital state data. The internal logic circuit 14 determines the current state of the system according to the state data provided by the analog-to-digital converter 16 and then sends the state data corresponding to the next state to the digital-to-analog converter 18. The digital-to-analog converter 18 converts the state data corresponding to the next state into another voltage level and writes it to the capacitor C. When the system is powered off, the capacitor C retains the voltage level stored therein for a while. Hence, after the system is powered on again, the internal logic circuit 14 may determine the state of the system according to the voltage level on the capacitor C. In this embodiment, each of the voltage levels corresponds to one of the states.

Figure 3:
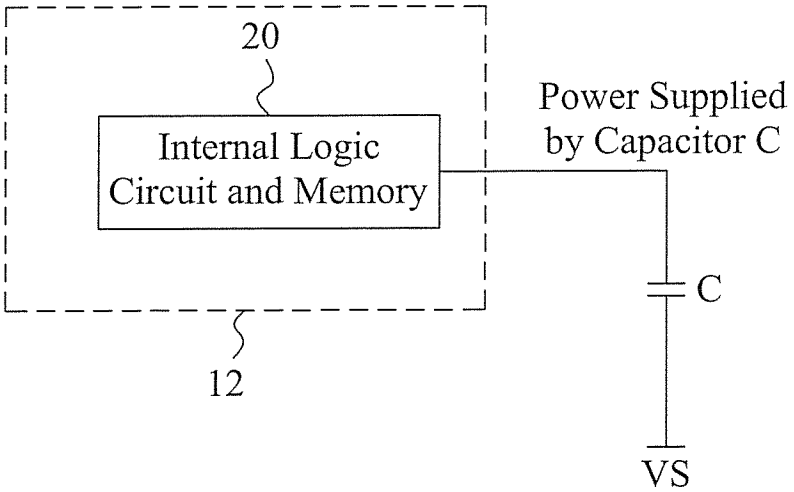
FIG. 3 shows a second embodiment for the internal circuit of FIG. 1.

FIG. 3 shows a second embodiment for the internal circuit 12 of FIG. 1, which includes an internal logic circuit and memory 20 for storing a state data. When the system is powered on, it reads the state data stored in the internal logic circuit and memory 20 so as to determine the current state. The capacitor C is charged during the system is on. Afterward, when the system is powered off, the capacitor C supplies power to the internal logic circuit and memory 20 so as for the state data stored in the internal logic circuit and memory 20 to be retained for a while. Hence, when the system is powered on again, it may read the state data stored in the internal logic circuit and memory 20 to determine the state of the system.

Figure 4:
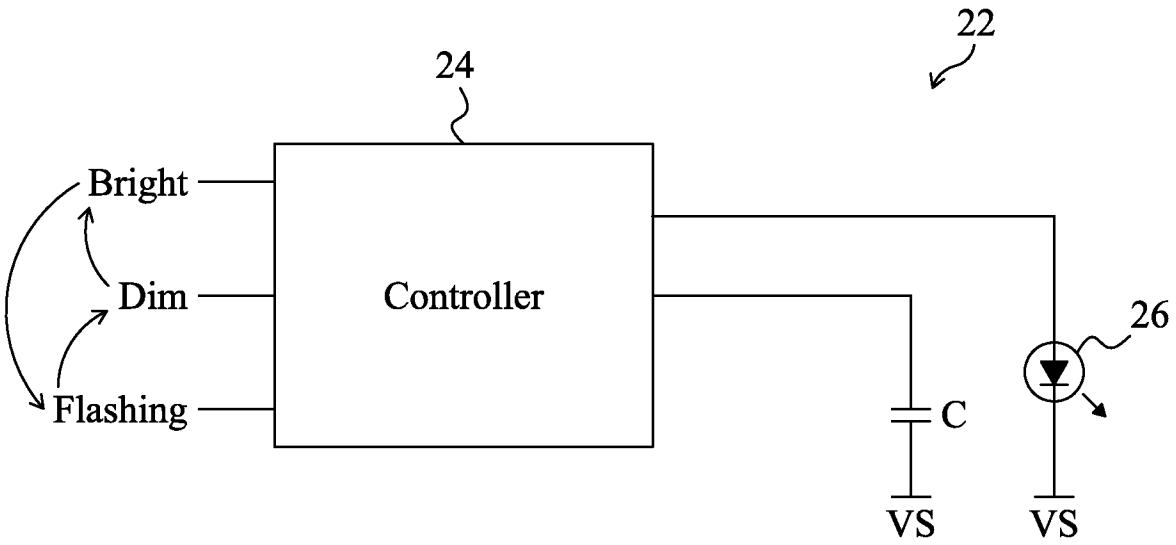
FIG. 4 shows an application of the state cycling apparatus of FIG. 1 to a LED flashlight.

FIG. 4 shows an application of the state cycling apparatus of FIG. 1 to a LED flashlight 26, the control circuit 22 of the LED flashlight 26 includes a controller 24 connected to the capacitor C. The controller 24 may switch the LED flashlight 26 between three states, namely a bright state, a dim state, and a flashing state. Assuming that the LED flashlight 26 is in the bright state when the voltage level of the capacitor C is less than 0.6V, the dim state when the voltage level of the capacitor C is between 0.6V and 1.2V, and the flashing state when the voltage level of the capacitor C is greater than 1.2V. At beginning, the voltage level of the capacitor C is 0V, and therefore, after the LED flashlight 26 is powered on, the controller 24 reads the voltage level of the capacitor C and determines that the current state of the LED flashlight 26 is the bright state. Then, the controller 24 writes a voltage level corresponding to the dim state to the capacitor C. After the LED flashlight 26 is powered off, the capacitor C retains the voltage level corresponding to the dim state for a while. Once the LED flashlight 26 is powered on again, the controller 24 will switch the LED flashlight 26 to the dim state according to the voltage level of the capacitor C and write a voltage level corresponding to the flashing state to the capacitor C. After the LED flashlight 26 is powered off and on again, the LED flashlight 26 is switched to the flashing state, and the controller 24 charges and discharges the capacitor C to generate a low oscillating frequency, say, 7 Hz, which functions as a flashing frequency during the flashing state. After the LED flashlight 26 is powered off and on once more, the LED flashlight 26 is restored to the bright state.

In addition to LED flashlights, the state cycling apparatus of the present invention is applicable to other LED lamps and non-LED lamps, such as illuminative lamps, decorative lamps, and traffic lights.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A control circuit for a lamp, comprising:

a capacitor for being charged while the lamp is on; and a controller connected to the capacitor, for switching the lamp between a plurality of states, said plurality of states including a flashing state;

wherein the controller reads a state data stored in the controller to determine a current state of the lamp when the lamp is powered on, and after the lamp is powered off, the capacitor supplies power to the controller to retain the state data stored in the controller.

2. The control circuit of claim 1, wherein the controller charges and discharges the capacitor to generate an oscillating frequency functioning as a flashing frequency during the flashing state.

3. A control circuit for a lamp, comprising:

a capacitor for being charged while the lamp is on; and a controller connected to the capacitor, for switching the lamp between a plurality of states;

wherein the controller reads a state data stored in the controller to determine a current state of the lamp when the lamp is powered on, and after the lamp is powered off, the capacitor supplies power to the controller to retain the state data stored in the controller.

* * * * *